US005269601A

United States Patent [19]

Williams et al.

[11] Patent Number: 5,269,601

[45] Date of Patent: Dec. 14, 1993

[54] METHOD AND APPARATUS FOR MAUNFACTURE OF PLASTIC REFRIGERATOR LINERS

[75] Inventors: Stephen G. Williams, Ohio Township, Warrick County, Ind.; David L. Schwartz, Ft. Smith, Ark.

[73] Assignee: Whirlpool Corporation, Benton Harbor, Mich.

[21] Appl. No.: 880,859

[22] Filed: May 11, 1992

[51] Int. Cl.[5] ..... A47B 81/00

[52] U.S. Cl. ..... 312/406.1

[58] Field of Search ..... 312/406, 406.1, 407; 220/467, 440

[56] References Cited

U.S. PATENT DOCUMENTS

| | | | |
|---|---|---|---|
| 2,028,943 | 1/1936 | Money | 113/120 |
| 2,876,927 | 3/1959 | Henning | 220/440 |
| 3,088,621 | 5/1963 | Brown | 220/440 X |
| 3,221,916 | 12/1965 | Rysgaard | 220/440 |
| 3,294,462 | 12/1966 | Kesling | 312/214 |
| 3,719,303 | 3/1973 | Kronenberger | 220/9 F |
| 3,813,137 | 5/1974 | Fellwock et al. | 312/214 |
| 3,835,660 | 9/1974 | Franck | 312/407 X |
| 3,940,195 | 2/1976 | Tillman | 312/406.1 |
| 3,944,111 | 3/1976 | Nonomaque et al. | 220/63 R |
| 4,053,972 | 10/1977 | Kordes | 29/423 |
| 4,130,615 | 12/1978 | Decker, Jr. et al. | 264/46.5 |
| 4,498,713 | 2/1985 | Fellwock et al. | 312/406.1 |
| 4,771,532 | 9/1988 | Taylor, Jr. et al. | 29/455.1 |
| 4,914,341 | 4/1990 | Weaver et al. | 312/407 |
| 5,033,182 | 7/1991 | Winterheimer et al. | 312/406.1 X |

FOREIGN PATENT DOCUMENTS

| | | | |
|---|---|---|---|
| 55-78894 | 6/1980 | Japan | 220/440 |
| 61-265483 | 11/1986 | Japan | 312/406 |
| 1138951 | 1/1969 | United Kingdom | 220/440 |
| 9014295 | 11/1990 | World Int. Prop. O. | 220/467 |

*Primary Examiner*—Rodney M. Lindsey

*Attorney, Agent, or Firm*—Thomas J. Roth; Stephen D. Krefman; Thomas E. Turcotte

[57] ABSTRACT

Plaques are formed on the sidewalls of the liner in a refrigerator to reduce thermally induced bowing of the cabinet. The plaques may consist of indentations in the liner, which in a preferred form are rectangular, or arrays of multiplanar indentations. The plaques provide increased surface area in the liner to permit thermal expansion without bowing, and also increase the structural rigidity of the liner to resist bowing. Thermal bowing is encountered where there are long unsupported wall surfaces and high temperature gradients across the wall. Therefore the plaques are very effective in the freezer compartment of a side-by-side refrigerator, where bowing can be severe in the absence of the disclosed corrective measure.

25 Claims, 6 Drawing Sheets

FIG. 6
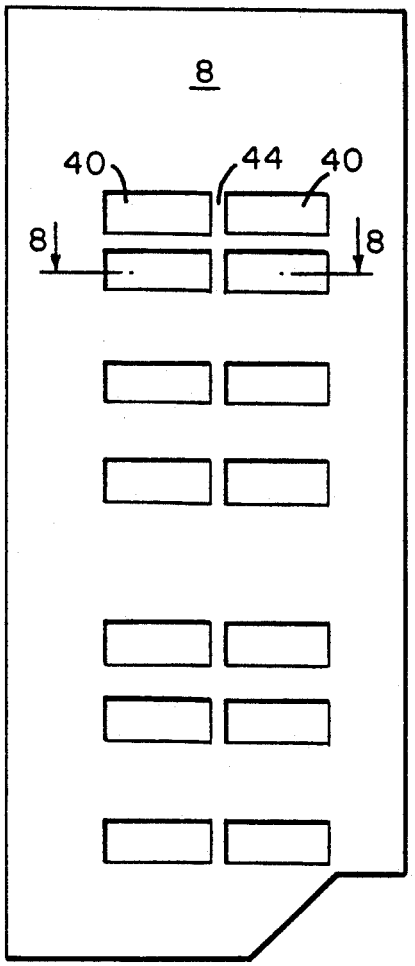
FIG. 7
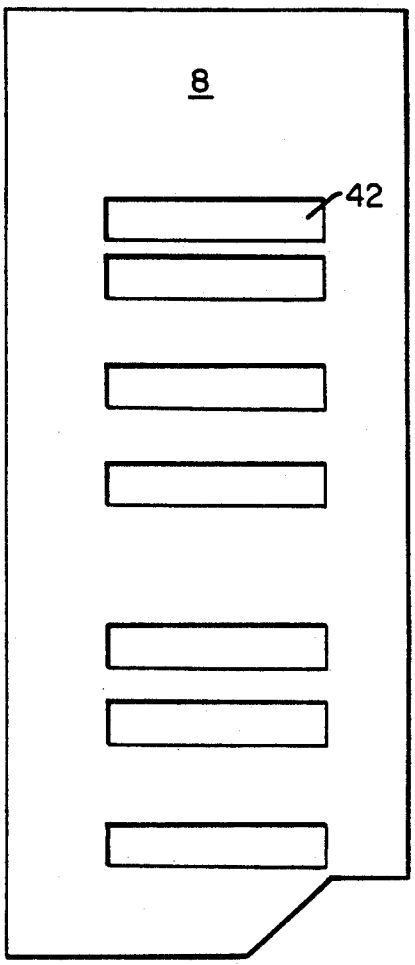
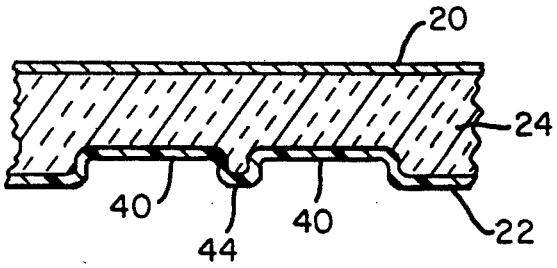
FIG. 8

METHOD AND APPARATUS FOR MAUNFACTURE OF PLASTIC REFRIGERATOR LINERS

BACKGROUND

1. Field Of The Invention

The present invention relates to a domestic refrigerator with "plaques" formed in the refrigerator cabinet walls to prevent thermal bowing of the cabinet.

2. Description Of The Prior Art

A current state of the art domestic refrigerator cabinet consists of an exterior prepainted steel shell, an interior plastic liner for dividing the cabinet interior into a fresh food compartment and a frozen food compartment, and a layer of foam between the metal shell and the plastic liner which acts as thermal insulation and provides structural rigidity to the refrigerator cabinet.

The inner liner may be formed to provide any of the common refrigerator configurations, including the top-mount type in which a horizontal separator divides the unit into an upper frozen food compartment and a lower fresh food compartment, the bottom-mount type which is essentially the inverse of the top-mount type, and the side-by-side type in which a central vertical separator divides the unit into side by side fresh and frozen food compartments.

Thermal bowing of the cabinet sidewalls is a serious problem in the above described refrigerator cabinets. It is believed that the temperature gradient which exists across the cabinet wall produces a bi-material effect, where the various materials in the cabinet wall expand or contract by a different amount in response to the temperature gradient. The interior plastic liner is exposed to the cooled interior of the refrigerator compartments, and the liner surface therefore tends to contract slightly. The exterior shell is exposed to a warm ambient temperature, and therefore tends to expand. Although the liner and shell surfaces respond differently to the thermal effects, they are locked together by the foam layer and may not move freely with respect to one another. As a result, the cabinet sidewalls tend to bow outward to compensate for the expansion and contraction of the different layers of the walls.

The bowing is generally more severe in cabinet walls adjacent to the frozen food compartment than in those adjacent to the fresh food compartment due to the greater temperature gradient across the freezer compartment walls. Side-by-side refrigerators are more susceptible to cabinet bowing than top-mount or bottom-mount cabinets because the side-by-side cabinet is divided vertically by a compartment separator wall, and lacks the horizontal divider of the top- or bottom-mount which to some extent ties the cabinet sidewalls together. Bowing of the cabinet sidewalls is of particular concern because the compartment shelves are sometimes mounted between the opposed sidewalls of the compartment, and when the cabinet bow is excessive the shelves are unable to span the increased distance and may collapse. Other detrimental effects of cabinet bowing include misalignment of the cabinet doors and door seals, misactivation of door-actuated switches, and increased energy consumption due to air leakage around the doors.

It is generally known in the art that refrigerator liners may have various forms of embossing and indentations for purposes such as to cover manufacturing imperfections in refrigerator liner sidewalls, to provide incremental increases in refrigerator volume, or to provide enhanced visual aesthetics in the refrigerator liner. However, it was not known previously that the presently disclosed plaques may be used to prevent cabinet bowing. U.S. Pat. No. 2,028,943 (Money) discloses a stamped metal refrigerator liner with raised ridges to increase the rigidity of the sidewalls, however this patent is not directed to reducing deformation of the entire cabinet wall. U.S. Pat. No. 4,053,972 (Kordes) shows a refrigerator door with apparently decorative rectangular liner indentations. U.S. Pat. No. 4,498,713 (Fellwock et al) discloses horizontal and vertical stress-relief ribs in a refrigerator cabinet liner. U.S. Pat. No. 4,914,341 (Weaver et al) discloses that horizontal ribs in a refrigerator door liner are effective to reduce door liner stress.

SUMMARY OF THE INVENTION

To overcome the problem of thermally-induced cabinet bowing, plaques are formed on the plastic inner liner. Each plaque consists of an indentation in the plastic inner liner in the direction of the foam insulation layer. The plaques are preferably rectangular in shape, and may be located in various configurations on the liner to avoid interfering with shelves and other mechanical components. Alternately, the plaques may consist of arrays of multiplanar indentations arranged on the liner surface.

It is believed that a combination of physical factors contribute to the effectiveness of the plaques at resisting cabinet bowing. First, the plaques increase the surface area of the liner, and the plaque edges act as small hinges, permitting planar surface expansion without causing bowing of the cabinet sidewall. Also, the plaques increase the structural rigidity of the liner and therefore resist thermal bowing.

The preferred embodiment of the present invention includes horizontally aligned pairs of rectangular plaques vertically spaced along the liner sidewall and compartment separator wall in the frozen food compartment of a side-by-side refrigerator. The horizontally aligned pairs of plaques are separated by a narrow vertical channel formed in the liner. Computer-simulated structural testing confirms that the narrow vertical channel provides increased structural rigidity and further resists thermal bowing deformation in the horizontal and vertical directions.

The plaques are also useful in preventing cabinet bowing in the fresh food compartment of a side-by-side refrigerator, as well as in the fresh and frozen food compartments of top-mount and bottom-mount refrigerator cabinets.

DESCRIPTION OF THE DRAWING

FIG. 6 is an elevational view of one sidewall of the frozen food compartment liner in a side-by-side refrigerator showing the preferred embodiment for the placement of plaques on the wall;

FIG. 7 is an elevational view of the frozen food compartment liner in a side-by-side refrigerator showing an alternate embodiment for the placement of plaques on the wall;

FIG. 8 is a partial horizontal sectional view of the preferred embodiment of FIG. 6 along line 8—8;

DETAILED DESCRIPTION OF THE PREFERRED EMBODIMENT

Figure 1:
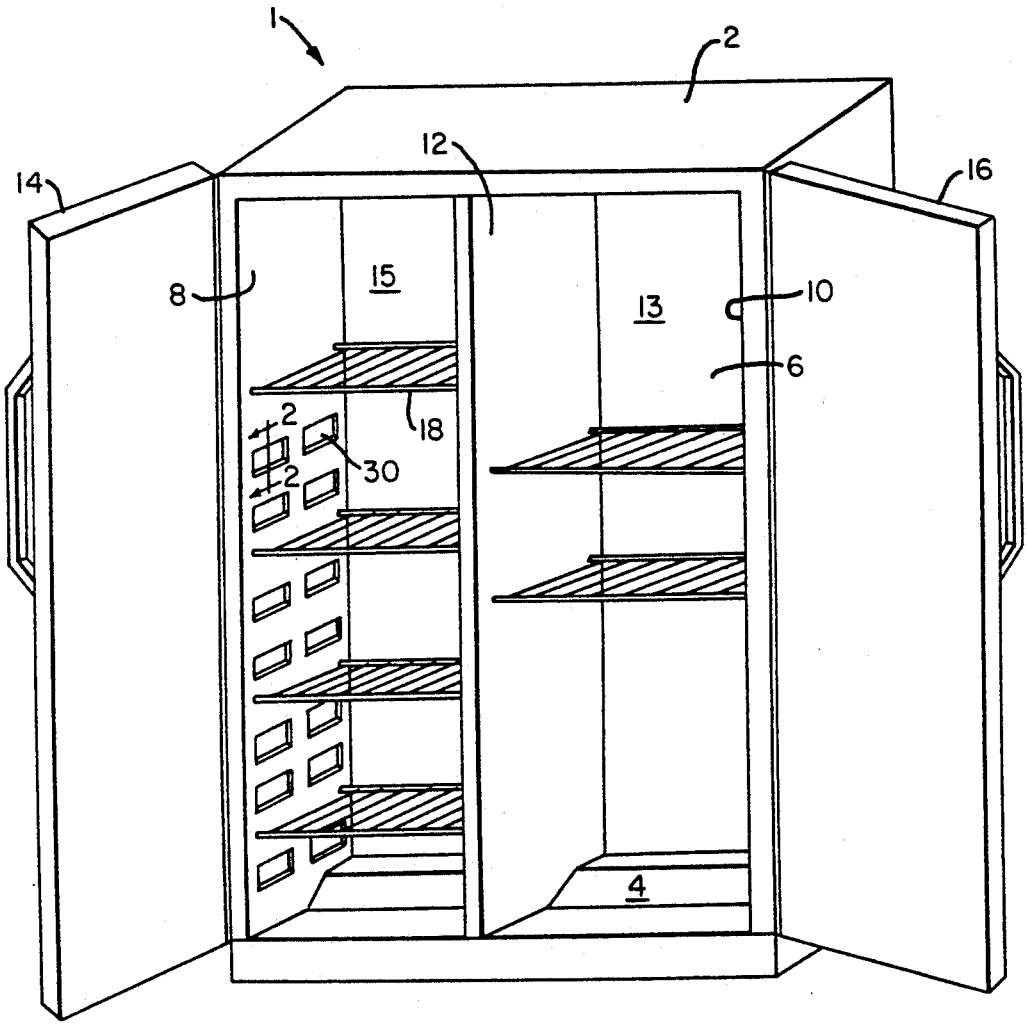
FIG. 1 is a front perspective view of a domestic side-by-side refrigerator with liner plaques formed in the sidewalls of the freezer compartment.

FIG. 1 shows a side-by-side refrigerator cabinet 1 consisting of several wall portions, including a top wall 2, a bottom wall 4, a back wall 6, first and second side walls 8 and 10, a compartment separator wall 12 located between the exterior side walls for dividing the cabinet interior into a fresh food compartment 13 and a frozen food compartment 15, and hinged doors 14 and 16 for closing the open fronts of the compartments. A number of shelves 18 are typically mounted in the compartments between the opposed sidewalls of each compartment. The shelves are mounted by any suitable means, such as by mounting structures, or socket structures protruding from the sides of the compartment walls.

Figure 2:
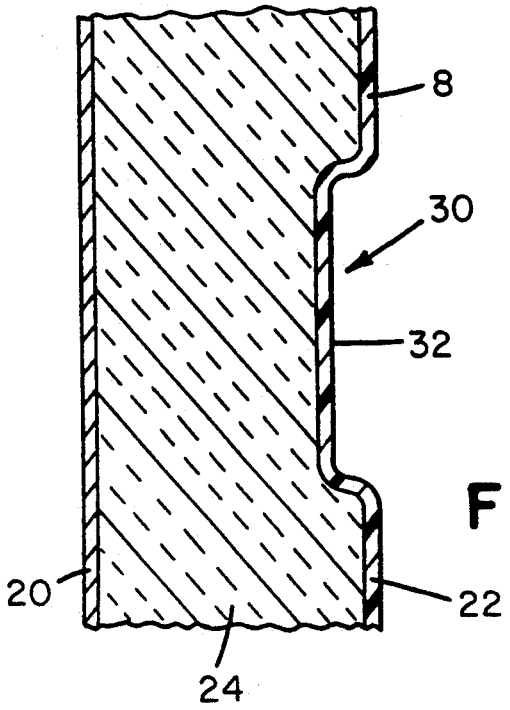
FIG. 2 is a partial vertical sectional view through one of the plaques in the exterior wall of the refrigerator cabinet along line 2—2 of FIG. 1.

Each of the exterior walls is a multi-layered structure 15 similar to that shown in FIG. 2, which shows a cross section of the freezer compartment sidewall 8 along line 2—2 of FIG. 1. The exterior layer 20 is typically a pre-painted steel shell which forms the exterior wrapper for the cabinet. The interior layer 22 is a plastic thermoformed liner made of high-impact polystyrene (HIPS) or other suitable material. The space between the steel shell and the plastic liner is filled with rigid foam insulation 24. The foam is initially deposited in the space in liquid form, and it then expands to fill the space. The foam eventually hardens and locks the inner liner to the outer shell, providing thermal insulation and structural support for the cabinet walls.

A sealed refrigeration system, generally consisting of a compressor and one or more heat exchange units, is provided to cool the fresh and frozen food compartments to temperatures suitable for the storage of food items. The frozen food compartment 15 is maintained at a temperature well below the freezing point of water, and the fresh food compartment 13 is maintained at a temperature slightly higher than the freezing point of water. Therefore, the differences between the refrigerated compartment temperatures and the room ambient temperature creates a significant temperature differential across the exterior refrigerator cabinet walls, and also across the interior cabinet wall which separates the fresh food and frozen food compartments.

Figure 3:
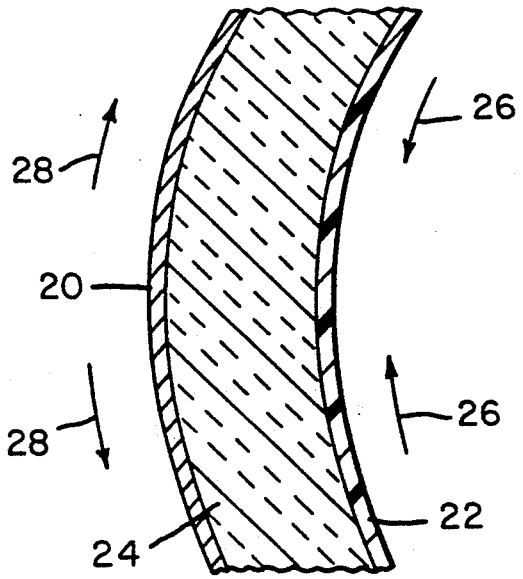
FIG. 3 is a partial vertical sectional view through one of the exterior walls of an unplaqued refrigerator cabinet illustrating in exaggerated scale the effects of thermally-induced cabinet bowing.

With this significant temperature differential, the refrigerator cabinet walls may be subject to thermally-induced bowing. As illustrated in FIG. 3 in exaggerated scale for clarity, the bi-material effect resulting from the different thermal properties of the cabinet wall materials causes the cooled surface of the interior liner 22 to contract slightly, as indicated by arrows 26, and in response to the relatively warm room ambient temperature causes the surface of the exterior shell 20 to expand slightly, as indicated by arrows 28. As a result, the cabinet sidewalls tend to bow outward. Refrigerator cabinet wall bowing of ½ inch has been observed, and may result in numerous problems in the product operation.

Figure 4:
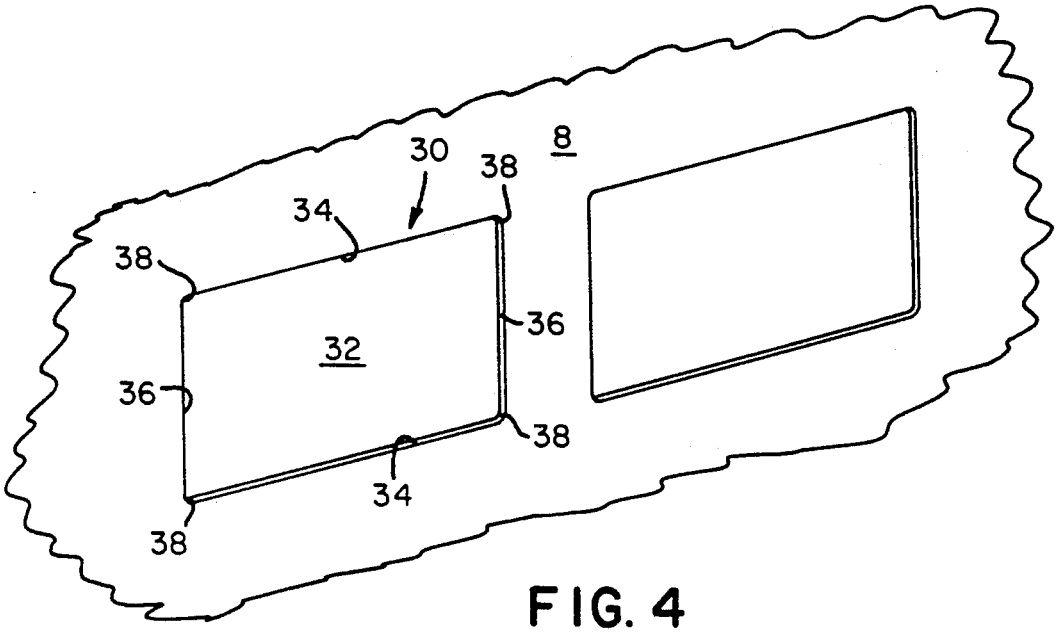
FIG. 4 is a partial perspective view of the liner of a domestic refrigerator showing liner plaques formed in accordance with the present invention.

Plaques 30 are formed into the side walls of the refrigerator cabinet to resist thermal bowing of the cabinet walls due to the temperature gradient across the side walls. As shown in FIG. 4, the plaques consist of indentations in the plastic inner liner which may be formed simultaneously with the thermoforming of the plastic liner. The plaques are generally rectangular in shape, and have a rectangular planar face 32 offset from the general plane of the plastic liner. Each plaque is bounded by a pair of horizontal edges 34 and a pair of vertical edges 36 which are radiused to provide a smooth transition between the surface of the liner and the surface of the plaque face. The corners 38 of each plaque are rounded to eliminate surface stress on the liner and for improved aesthetics.

The plaque configuration is incorporated into the liner thermoform tooling so that the liner 22 and plaques 30 are formed in a single manufacturing step. The liner 22 is then inserted into the formed exterior shell 20, and liquified foam is placed in the space between the liner and shell. The foam 24 expands and hardens in the space, filling the area between the shell, the liner, and the plaques. The rectangular face 32 and the edge portions 36 and 38 of the plaques are surrounded by the foam, as shown in FIG. 2. The resulting refrigerator cabinet is a unitary structural assembly, with the liner, foam, and shell firmly locked together.

It is believed that a number of factors combine to make the resulting plaqued refrigerator cabinet uniquely resistant to thermally-induced bowing. Rather than focus solely on the effect of the plaques on the liner, it is important to view the plaques as they relate to the liner, the foam, and the shell as a unitary structural assembly.

Figure 5A:
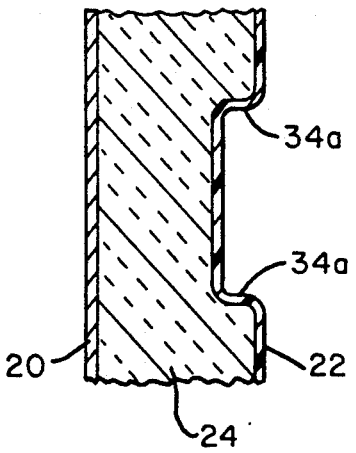
FIGS. 5(*a*) and 5(*b*) are partial vertical sectional views through one of the exterior walls of the plaqued refrigerator cabinet illustrating in exaggerated scale the expansion-joint effect of the plaque in response to thermal forces, with FIG. 5(*a*) illustrating the normal configuration of the plaque without expansion forces, and FIG. 5(*b*) illustrating the absorption of surface expansion forces without bowing.
Figure 5B:
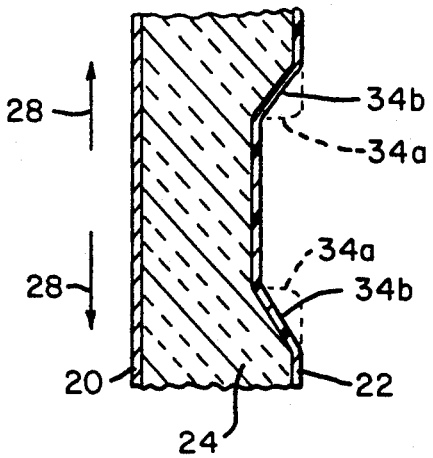

First, the horizontal and vertical edge portions of the plaques, 34 and 36 respectively, function as small expansion joints between the liner surface and the plaque surfaces, and are able to compensate for surface contraction and expansion without causing surface bowing. FIG. 5(*a*) illustrates the refrigerator wall configuration in the vicinity of the plaque in its unstressed configuration. As the exterior shell 20 expands, forces 28 are transmitted through the foam layer 24 to the liner 22, creating tension on the liner surface. FIG. 5(*b*) illustrates in exaggerated scale for clarity that the plaque edges are able to flex slightly from their original configuration 34*a* to an extended configuration 34*b* to relieve the surface tension on the liner. Expansion and contraction of the entire cabinet wall assembly can then take place without bowing.

Test results confirm that the plaques are effective as expansion joints to relieve liner surface tension. Table 1 below shows the results of tensile deflection testing on samples of plaqued and unplaqued HIPS refrigerator liners. The unplaqued samples exhibited yield forces which averaged 146,000 psi at 1% tensile deflection. The plaqued samples exhibited yield forces which averaged 32,000 psi at 1% tensile deflection. Because the plaqued liner samples have only 22% of the internal stiffness of the flat unplaqued liner samples, the plaqued material is more resistant to cabinet bowing due to the reduction of internal liner wall stiffness.

TABLE 1

TENSILE DEFLECTION TESTING OF PLAQUED AND UNPLAQUED HIPS LINER SAMPLES

| Sample Configuration | Tensile Deflection | Yield Force (psi) |
|---|---|---|
| Unplaqued HIPS | 1% | 146,000 psi |
| Plaqued HIPS | 1% | 32,000 psi |

Second, the plaqued liner surface 22 is itself inherently more structurally rigid than a comparable unplaqued piece of the same material. The plaque edge portions are angularly offset from the planes of the liner and plaque surfaces, forming beam structures on the liner surface. The horizontal and vertical pairs of plaques edges, 34 and 36 respectively, thus resist bowing about the horizontal and vertical axes of the liner due to this beam effect. When the liner is bonded to the foam 24 and steel shell 20, the entire structural assembly is then more rigid and resistant to bowing.

The plaques 30 then serve both as a structural stiffener to resist bowing deformation, and as liner internal tension relief elements. The physical configuration of the plaques determines their effectiveness in preventing deformation.

Computer finite element analysis testing indicates that the degree of cabinet bowing is inversely proportional to the distance by which the plaque surface is offset from the surface of the liner. Table 2 indicates the relationship between liner plaque depth and percentage decrease of cabinet deformation for a plaque configuration as shown in FIG. 7 compared to a unplaqued liner. A plaque depth of 1/16 inch resulted in a 14.6% decrease in wall deformation over an unplaqued wall, while a plaque depth of ⅛ inch resulted in a 17.8% decrease in wall deformation. The testing suggests that increasing the plaque depth beyond ⅛ inch ¼ inch, or possibly deeper, would result in further incremental improvements in the resistance to wall deformation. However, these greater plaque depths have not been tested, and may require more significant modification to the liner tooling.

TABLE 2

EFFECT OF PLAQUE DEPTH ON CABINET WALL DEFORMATION

| Liner Configuration | Plaque Depth (inches) | Percent Decrease In Wall Deformation |
|---|---|---|
| Unplaqued | 0.0 | 0.0% |
| Plaqued | 0.0625 | 14.6% |
| Plaqued | 0.1250 | 17.8% |

The preferred embodiment of a refrigerator cabinet with liner plaques is shown in FIG. 6. It has been determined that providing horizontally aligned pairs of plaques spaced vertically along the liner wall as shown in FIG. 6 increases the resistance to deformation over a liner having larger single plaques spaced vertically along the wall, as shown in FIG. 7. The preferred embodiment of FIG. 6 is nearly identical to the configuration of FIG. 7, except that the large plaques 42 of FIG. 7 are divided into horizontally-aligned pairs 40 in FIG. 6 by the vertical "channel" 44 formed in the liner. The improved bowing resistance of the preferred embodiment is believed to result from the structural rigidity of the vertical liner channel 44 between the aligned pairs of plaques 40 running the length of the liner wall.

Channel 44 is an uninterrupted planar vertical strip of liner material which separates the individual plaques 40 in each of the horizontally aligned plaque pairs. In the cross-section view shown in FIG. 8, the channel 44 is coplanar with the general plane of the refrigerator liner 8 beyond plaques 44, although the channel may also conceivably be offset from the general plane of the liner.

Table 3 indicates the dramatic decrease in wall deformation resulting from the provision of the vertical channel of FIG. 6. The liner configuration of FIG. 7 with a plaque depth of ⅛ inch provides a 17.8% decrease in wall deformation over an unplaqued liner. The liner configuration of FIG. 6, which has a plaque depth of ⅛ inch and vertical spacing of plaques similar to that of FIG. 7, but with the addition of the vertical channel 42 splitting the plaques into horizontally aligned pairs 40, provides a 31% decrease in wall deformation over an unplaqued liner.

TABLE 3

EFFECT OF VERTICAL CHANNEL ON CABINET WALL DEFORMATION

| Liner Configuration | Percent Decrease In Wall Deformation |
|---|---|
| Unplaqued | 0.0% |
| Plaqued, no channel | 17.8% |
| Plaqued with channel | 31.0% |

Figure 10:
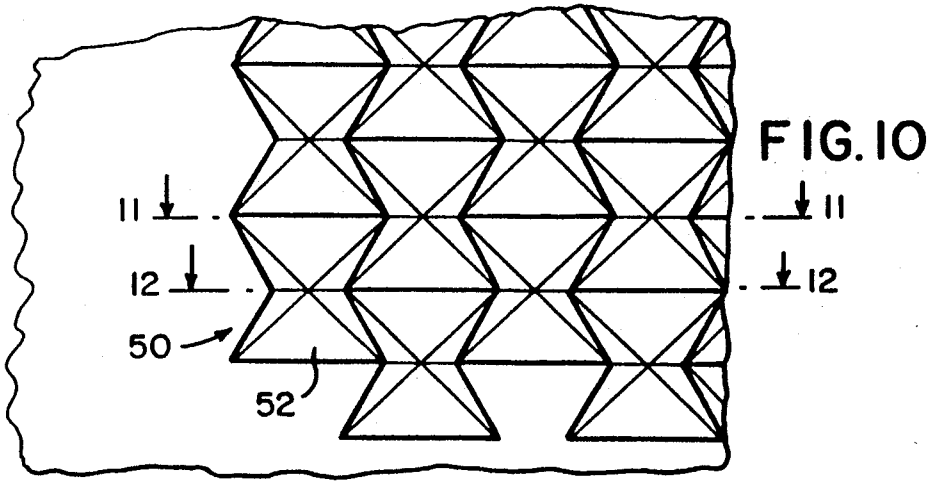
FIG. 10 an elevational view of a portion of an array of multiplanar formations of the type comprising the array of FIG. 9.
Figure 11:
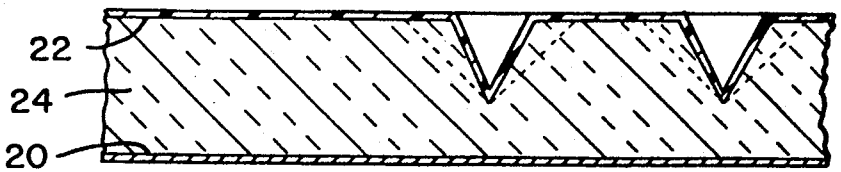
FIG. 11 is a sectional view along line 11—11 of FIG. 10.
Figure 12:
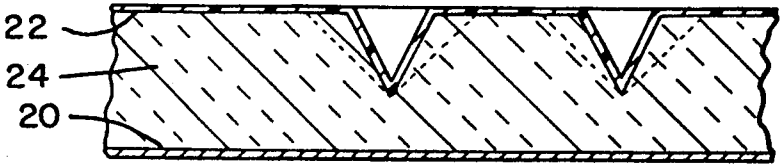
FIG. 12 is a sectional view along line 12—12 of FIG. 10.
Figure 9:
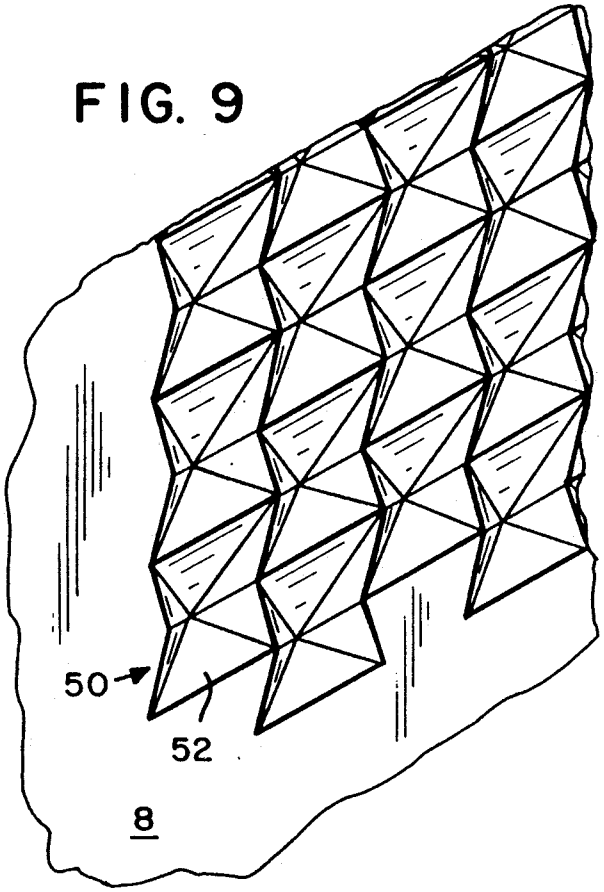
FIG. 9 is a partial perspective view of a refrigerator liner showing a first embodiment of an array of multiplanar formations to prevent refrigerator cabinet bowing.
Figure 13:
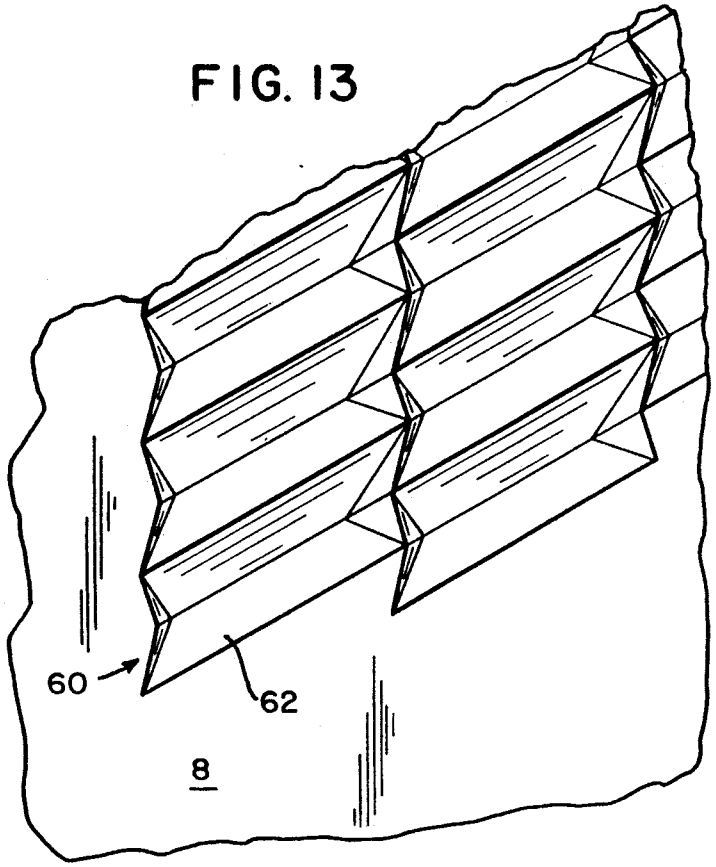
FIG. 13 is a partial perspective view of a refrigerator liner showing a second embodiment of an array of multiplanar formations to prevent refrigerator cabinet bowing.

FIGS. 9 through 16 are directed to a different type of structure for reducing bowing in a refrigerator cabinet. Both FIGS. 9 and 13 show arrays 50 and 60, respectively, of adjacent identical multiplanar indentations 52 and 62, respectively, in the liner surface 8. FIG. 10 shows how the individual multiplanar indentations 52 fit together to make up the array of FIG. 9. The structure of FIG. 10 consists of 6 planar surfaces which form a hybrid pyramid shape projecting into the foam layer of the refrigerator cabinet wall. FIGS. 11 and 12 are sectional views through the refrigerator cabinet along lines 11—11 and 12—12, respectively, of FIG. 10, and show the details of the liner profile.

Figure 14:
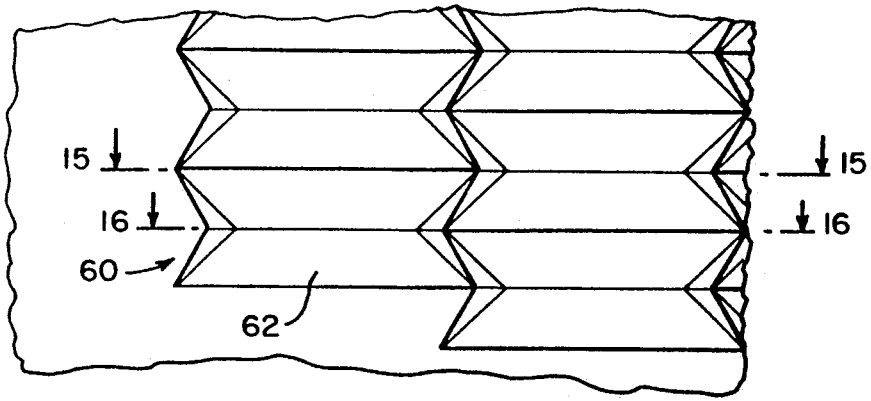
FIG. 14 an elevational view of a portion of an array of multiplanar formations of the type comprising the array of FIG. 13.
Figure 15:
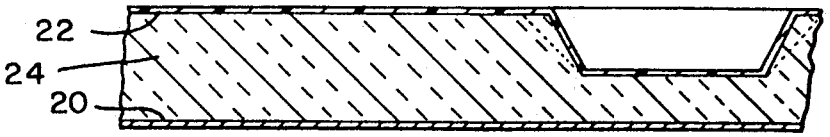
FIG. 15 is a sectional view along line 15—15 of FIG. 14.
Figure 16:
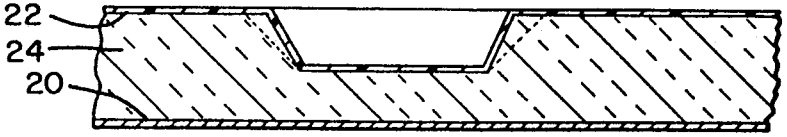
FIG. 16 is a sectional view along line 16—16 of FIG. 14.

FIG. 13 shows an array 60 of differently shaped indentations 62 in liner surface 8. FIG. 14 shows how the individual multiplanar indentations 62 fit together to make up the array of FIG. 13. The indentation 62 of FIG. 14 consists of 6 planar surfaces which form an elongated hybrid pyramid shape projecting into the foam layer of the refrigerator cabinet wall. FIGS. 15 and 16 are sectional views through the refrigerator cabinet along lines 15—15 and 16—16, respectively, of FIG. 14, and show the details of the liner profile.

In each version of the multiplanar formations shown in FIGS. 9, 10, 13 and 14, the various planar surfaces which comprise the multiplanar formation are capable of flexure with respect to one another about their adjacent edges to absorb thermally induced expansion and contraction of the refrigerator wall structure without bowing. As can be seen from the orientations of the various edges, these formations are capable of flexure in response to diagonal forces as well as horizontal and vertical forces. Arrangement of the individual multiplanar formations in arrays multiplies the effect of the individual structures.

The arrays may be placed in an arrangement similar to the rectangular plaques of FIGS. 6 and 7 to avoid interference with shelf structures and other mechanical components mounted on the refrigerator liner.

The discussions provided in this specification are primarily directed to the use of plaques on side-by-side domestic refrigerators where the problems of cabinet bowing are severe. However, it should be understood that the present invention is not intended to be limited to side-by-side refrigerators, or to domestic refrigeration products in general, and may be useful to resist thermal bowing in a broad array of applications. It is also to be understood that, in light of the above teachings, the preferred configuration of the invention described in this specification is susceptible to various changes of form, proportions, and details of construction, all of which are intended to fall within the scope of the appended claims.

What is claimed is:

1. Thermally-induced bowing reduction means for an insulating wall structure, wherein said wall structure comprises bonded-together layers of an exterior metal shell, an intermediate rigid foam insulating layer, and an interior planar plastic layer, wherein said bowing reduction means comprises at least one plaque formed on said interior plastic layer, said plaque comprising:

a planar surface integrally formed with said interior plastic layer and offset from the plane of said interior plastic layer in the direction of said foam layer by a predetermined distance; and edge portions defining the boundaries of said planar surface and extending between the planar surface of said plaque and the plane of said interior plastic layer, said edge portions providing:

expansion joints between the plane of said interior plastic layer and the plane of said planar surface such that said edge portions are capable of flexure to absorb thermally-induced contraction and expansion of the interior plastic layer, and beam elements on said interior plastic layer preventing bowing of said interior plastic layer;

said intermediate foam insulating layer closely embracing said edge portions.

2. The bowing reduction means of claim 1 wherein said planar surface of each plaque is generally rectangular in shape.

3. The bowing reduction means of claim 1 wherein said planar surfaces of said plaques are offset from the plane of said interior plastic liner by between 0.0625 and 0.25 inches.

4. The bowing reduction means of claim 2 comprising at least one aligned pair of plaques, said aligned pair comprising first and second plaques disposed adjacent to one another on said interior plastic liner, with said first plaque having an edge portion of said substantially rectangular planar surface adjacent to an edge portion of said second plaque, and said first and second plaques being separated from one another by a channel disposed between said adjacent edge portions of said aligned pair of plaques.

5. The bowing reduction means of claim 4 wherein said channel comprises a surface coplanar with said interior plastic liner surface.

6. The bowing reduction means of claim 5 comprising a plurality of aligned pairs of plaques, each of said aligned pairs comprising a channel disposed between said first and second plaques in said aligned pair, wherein the channels of each of said plurality of aligned pairs are in alignment along said interior plastic liner.

7. An improved refrigerator cabinet structure including first and second vertical sidewalls and an interior cabinet divider wall, where each of said wall structures is formed of bonded together layers comprising a planar layer of interior plastic liner, an opposed planar layer, and an intermediate layer of insulating foam disposed between said interior plastic liner and said opposed layer, wherein said improved refrigerator cabinet includes means to reduce thermally-induced bowing of said walls, said bow-reduction means comprising:

at least one plaque formed in said interior plastic liner, said plaque comprising a substantially rectangular planar surface parallel to the plane of said interior plastic liner and offset therefrom by a predetermined distance in the direction of said intermediate foam layer; and edge portions defining the boundaries of said substantially rectangular planar surface and extending between the planar surface of said plaque and the plane of said interior plastic layer, said edge portions providing:

expansion joints between the plane of said interior plastic layer and the plane of said substantially rectangular planar surface such that said edge portions are capable of flexure to absorb thermally-induced contraction and expansion of the interior plastic liner surface, and beam elements on said interior plastic layer preventing bowing of said interior plastic layer;

said intermediate foam insulating layer closely embracing said edge portions.

8. The refrigerator cabinet of claim 7 wherein said opposed planar layer of said cabinet wall is a layer of plastic liner material on said interior cabinet divider wall.

9. The refrigerator cabinet of claim 7 wherein said planar surfaces of said plaques are offset from the plane of said interior plastic liner by between 0.0625 and 0.25 inches.

10. The refrigerator cabinet of claim 7 wherein said opposed planar layer of said cabinet wall is an exterior steel shell of said refrigerator cabinet.

11. The refrigerator cabinet of claim 7 comprising at least one horizontally aligned pair of plaques, with said aligned pair comprising first and second plaques disposed adjacent to one another on said interior plastic liner, with said first plaque in said aligned pair having a vertical edge portion adjacent to a vertical edge portion of said second plaque in said horizontally aligned pair, and said first and second plaques being separated from one another by a vertical channel disposed between said adjacent vertical edges, with said channel having a surface coplanar with the surface of said interior plastic liner.

12. The refrigerator cabinet of claim 11 where said channel has a surface coplanar with the plane of said interior plastic liner.

13. The refrigerator cabinet of claim 11 comprising a plurality of horizontally aligned pairs of plaques, wherein said individual horizontally aligned pairs of plaques are vertically spaced along the surface of said interior plastic liner.

14. The refrigerator cabinet of claim 13 wherein each of said horizontally aligned pairs includes a vertical channel disposed between said individual plaques in said horizontally aligned pair, wherein the individual vertical channels of each of said plurality of horizontally aligned pairs are vertically aligned along said interior plastic liner.

15. An improved cabinet structure for a side-by-side domestic refrigerator appliance, wherein said cabinet includes first and second vertical outer sidewalls, each of said outer sidewalls formed of bonded together layers comprising a substantially planar metal shell facing the exterior of said cabinet, a substantially planar plastic liner facing the interior of said cabinet, an intermediate layer of insulating foam between said metal shell and said plastic liner, and a vertical compartment separator wall interposed between said first and second outer sidewalls for dividing the interior space of said cabinet into a frozen food compartment and a fresh food compartment, where said separator wall is formed from first and second spaced apart planar layers of plastic liner, with the first of said layers of plastic liner facing the interior of said fresh food compartment, and the second of said layers of plastic liner facing the interior of said frozen food compartment, and an intermediate layer of insulating foam between said first and second layers of plastic liner of said separator wall, wherein said improved side-by-side refrigerator cabinet includes means to reduce thermally-induced cabinet bowing of said sidewalls and said separator wall, said bow-reduction means comprising:

at least one plaque formation on said substantially planar plastic liner, said plaque formation comprising at least one substantially planar rectangular surface formed integrally with said interior plastic liner and offset therefrom in the direction of said foam by a predetermined distance, each of said rectangular surfaces further comprising two vertical edge portions and two horizontal edge portions defining the boundary of said rectangular plaque and extending between the planar surface of said plaque and the surface of said plastic interior liner, said edge portions providing:

expansion joints between the plane of said interior plastic layer and the plane of said substantially rectangular planar surface such that said edge portions are capable of flexure to absorb thermally-induced contraction and expansion of the inter plastic liner surface, and beam elements on said interior plastic layer preventing bowing of said interior plastic layer;

said intermediate foam insulating layer closely embracing said edge portions.

16. The refrigerator cabinet of claim 15 wherein said rectangular planar surfaces of said plaques are offset from the plane of said inner plastic liner by 0.125 inches.

17. The refrigerator cabinet structure of claim 15 wherein said plaque formation comprises a single rectangular plaque, and a plurality of said rectangular plaques are spaced vertically along said interior plastic liner.

18. The refrigerator cabinet structure of claim 15 wherein each of said plaque formations comprises a horizontally aligned pair of plaques, with said aligned pair comprising first and second plaques disposed adjacent to one another on said interior plastic liner, with said first plaque in said aligned pair having a vertical edge portion adjacent to a vertical edge portion of said second plaque in said horizontally aligned pair, and said first and second plaques being separated from one another by a vertical channel disposed between said adjacent vertical edges, with said channel having a surface coplanar with the surface of said interior plastic liner.

19. The refrigerator cabinet of claim 18 comprising a plurality of horizontally aligned pairs of plaques, wherein said individual horizontally aligned pairs of plaques are vertically spaced along the surface of said interior plastic liner.

20. The refrigerator cabinet of claim 19 wherein each of said horizontally aligned pairs includes a vertical channel disposed between said individual plaques in said horizontally aligned pair, wherein the individual vertical channels of each of said plurality of horizontally aligned pairs are vertically aligned along said interior plastic liner.

21. The refrigerator cabinet of claim 15 wherein said rectangular planar surfaces of said plaques are offset from the plane of said inner plastic liner by between 0.0625 and 0.25 inches.

22. An improved refrigerator cabinet structure including first and second vertical sidewalls, each of said sidewalls formed of bonded together layers comprising a substantially planar exterior metal shell, a substantially planar interior plastic liner having a general plane, and an intermediate layer of insulating foam, wherein said improved refrigerator cabinet includes means to reduce thermally-induced cabinet bowing, said bow-reduction means comprising:

an array of substantially identical adjacent multiplanar formations of said plastic liner, each of said multiplanar formations comprising:

a predetermined number of adjacent intersecting planar surfaces angularly offset from said general plane of said plastic liner in the direction of said foam, each planar surface comprising at least three linear edge portions including:

a single linear base edge which intersects said general plane along a line segment, and first and second linear side edges, wherein each of said linear side edges defines the intersection of said planar surface with an adjacent planar surface along a line segment; and wherein a plurality of said multiplanar formations are formed on said plastic liner surface and are disposed adjacent one another in an array such that at least one base edge of each of said multiplanar formations intersect with a base edge of an adjacent multiplanar formation along a line segment;

and each of said edge portions providing:

expansion joints between the plane of said interior plastic layer and the plane of said substantially rectangular planar surface such that said edge portions are capable of flexure to absorb thermally-induced contraction and expansion of the interior plastic liner surface, and beam elements of said interior plastic layer preventing bowing of said interior plastic layer;

said intermediate foam insulating layer closely embracing said edge portions.

23. The improved refrigerator cabinet structure of claim 22 wherein each of said substantially identical multiplanar formations comprises six adjacent planar surfaces, wherein each of said planar surfaces is triangular in shape, and all of said planar surfaces in said multiplanar formation intersect with one another at a single point.

24. The improved refrigerator cabinet structure of claim 22 wherein two of said planar surfaces in each of said substantially identical multiplanar formation comprise four linear edge portions, including a remote edge, wherein said remote edges of both of said four-edged planar surfaces intersect along a line segment.

25. The improved refrigerator cabinet structure of claim 24 wherein each of said substantially identical multiplanar formations comprises six adjacent planar surfaces, wherein four of said planar surfaces are triangular in shape, and comprise three edges, including a base edge and a first and second side edges, and two of said planar surfaces are trapezoidal in shape, and comprise four edges, including a base edge, first and second side edges, and a remote edge, and wherein said remote edges of both of said trapezoidal planar surfaces intersect along a line segment.

* * * * *